US011634925B2

(12) United States Patent
Sun et al.

(10) Patent No.: US 11,634,925 B2
(45) Date of Patent: Apr. 25, 2023

(54) FOLDING CANOPY WITH LAYERED ROOF

(71) Applicant: ZHEJIANG JIANSHENG LEISURE PRODUCTS CO., LTD, Zhejiang (CN)

(72) Inventors: Yuanru Sun, Zhejiang (CN); Weijun Xu, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 43 days.

(21) Appl. No.: 17/299,793

(22) PCT Filed: Mar. 26, 2021

(86) PCT No.: PCT/CN2021/083183
§ 371 (c)(1),
(2) Date: Jun. 4, 2021

(87) PCT Pub. No.: WO2022/165951
PCT Pub. Date: Aug. 11, 2022

(65) Prior Publication Data

US 2022/0268052 A1 Aug. 25, 2022

(30) Foreign Application Priority Data

Feb. 2, 2021 (CN) ..... 202110142181.1

(51) Int. Cl.
*E04H 15/50* (2006.01)
*E04H 15/54* (2006.01)
*E04H 15/16* (2006.01)

(52) U.S. Cl.
CPC ..... *E04H 15/50* (2013.01); *E04H 15/16* (2013.01); *E04H 15/54* (2013.01)

(58) Field of Classification Search
CPC ..... E04H 15/50; E04H 15/16
See application file for complete search history.

(56) References Cited

U.S. PATENT DOCUMENTS 9,995,057 B2 * 6/2018 Wu ..... E04H 15/54
10,041,272 B2 * 8/2018 Choi ..... E04H 15/50
(Continued)

FOREIGN PATENT DOCUMENTS

CN 2828223 10/2006
CN 2856284 Y * 1/2007
(Continued)

OTHER PUBLICATIONS

"Written Opinion of the International Searching Authority (Form PCT/ISA/237) of PCT/CN2021/083183," dated Nov. 3, 2021, with English translation thereof, pp. 1-8.

*Primary Examiner* — David R Dunn
*Assistant Examiner* — Danielle Jackson
(74) *Attorney, Agent, or Firm* — JCIP Global Inc.

(57) ABSTRACT

A folding canopy with a layered roof includes canopy leg tubes, a beam assembly connected between the canopy leg tubes, and a roof assembly for supporting a tarpaulin. The roof assembly includes a first roof unit in a middle portion of the roof assembly and a second roof unit surrounding the first roof unit. The first roof unit includes a first tarpaulin, a tarpaulin stay for supporting the first tarpaulin, and a linkage rod for linkage of the tarpaulin stay. A middle portion of the tarpaulin stay is hinged with a first strut, one end of the tarpaulin stay is hinged with an end of the linkage rod and the other end of the tarpaulin stay is a free end, and the other end of the linkage rod is hinged with a second strut.

10 Claims, 10 Drawing Sheets

(56) References Cited

U.S. PATENT DOCUMENTS

| | | | | |
|---|---|---|---|---|
| 10,487,531 | B2 * | 11/2019 | Volin | E04H 15/50 |
| 10,669,738 | B2 * | 6/2020 | Yang | E04H 15/50 |
| 2010/0043856 | A1 * | 2/2010 | Park | E04H 15/50 135/145 |
| 2013/0247948 | A1 * | 9/2013 | Lovley | E04H 15/50 135/145 |
| 2019/0368220 | A1 * | 12/2019 | Sun | E04H 15/50 |
| 2019/0368232 | A1 * | 12/2019 | Sun | E04H 15/505 |
| 2020/0157838 | A1 * | 5/2020 | Yuan | E04H 15/50 |
| 2020/0240167 | A1 * | 7/2020 | Sun | E04H 15/48 |
| 2021/0040766 | A1 * | 2/2021 | Sun | E04H 15/32 |
| 2021/0355703 | A1 * | 11/2021 | Sun | E04H 15/50 |
| 2022/0034118 | A1 * | 2/2022 | Sun | E04H 15/50 |
| 2022/0268052 | A1 * | 8/2022 | Sun | E04H 15/50 |

FOREIGN PATENT DOCUMENTS

| | | | | |
|---|---|---|---|---|
| CN | 106639628 | A * | 5/2017 | |
| CN | 209067000 | | 7/2019 | |
| CN | 112324238 | A * | 2/2021 | E04H 15/48 |
| DE | 202021106603 | U1 * | 2/2022 | |

* cited by examiner

FOLDING CANOPY WITH LAYERED ROOF

CROSS-REFERENCE TO RELATED APPLICATION

This application is a 371 of international application of PCT application serial no. PCT/CN2021/083183, filed on Mar. 26, 2021, which claims the priority benefit of China application no. 202110142181.1 filed on Feb. 2, 2021. The entirety of each of the above mentioned patent applications is hereby incorporated by reference herein and made a part of this specification.

BACKGROUND

Technical Field

The present invention relates to the technical field of outdoor folding canopy, in particular, to a folding canopy with layered roof.

DESCRIPTION OF RELATED ART

As an outdoor leisure product, canopies are widely used in beaches, courtyards, lawns and other occasions. To realize the breathability of canopies, canopies with double-layer roof came into being. The existing canopies with double-layer roof usually have a small roof with a fixed structure, and the canopy is usually fixed as a whole. The structure with a suspended roof in the middle is relatively rare among the folding canopies. The folding canopies can be folded and unfolded in one minute, and are simple to operate and easy to install. And with characteristics of being smart, durable, easy to carry, the folding canopies have broad market prospects.

The patent publication No. CN2828223 discloses a folding canopy with double-layer roof. The folding canopy includes a folding lower-roof canopy frame and a lower-roof canopy tarpaulin covering the lower-roof canopy frame to be co-fixed at a middle gap; a folding upper-roof canopy frame is movably connected to the lower-roof canopy frame, and an upper-roof canopy tarpaulin covers the upper-roof canopy frame to be co-fixed. However, when the canopy is unfolded as a whole, the folding upper-roof canopy frame in the structure shows a relatively poor performance, and a shaking is easily to be caused between the folding upper-roof canopy and the lower-roof canopy frame, resulting in a relatively poor supporting effect of a center roof, and the unfolding of the structure and the assembly of components are relatively cumbersome, resulting in a relatively poor overall use effect. In addition, after the canopy is folded, an overall volume of the canopy is relatively large due to the interference of the internal folding roof, which affects a packaging size; in addition, the center roof of the existing folding canopy with double-layer roof is usually limited by a structure, such that an overall covering area is relatively small and cannot be adjusted according to requirements. In addition, for the existing upper-roof canopy tarpaulin, after the upper-roof canopy frame is folded, the upper-roof canopy frame usually continuously unfolds for the upper-roof canopy tarpaulin, which causes the upper-roof canopy tarpaulin to always be in tension. The upper-roof canopy tarpaulin is easily to be excessively stretched when used for a long time. When the folding canopy is unfolded, the covered upper-roof canopy tarpaulin is prone to collapse, which affects the appearance.

SUMMARY

The object of the present invention is to provide a folding canopy with a layered roof for solving the above technical problem. The present invention has the characteristics of stable and compact structure and being smooth to fold and unfold.

The technical problem solved by the present invention may be implemented by the following technical solutions.

A folding canopy with a layered roof includes canopy leg tubes, a beam assembly connected between the canopy leg tubes, and a roof assembly for supporting a tarpaulin. The roof assembly includes a first roof unit in a middle portion of the roof assembly and a second roof unit surrounding the first roof unit, the first roof unit includes a first tarpaulin, a tarpaulin stay for supporting the first tarpaulin, and a linkage rod for linkage of the tarpaulin stay, a middle portion of the tarpaulin stay is hinged with a first strut, one end of the tarpaulin stay is hinged with an end of the linkage rod and the other end of the tarpaulin stay is a free end, and the other end of the linkage rod is hinged with a second strut. When the folding canopy is fully unfolded, the free end of the tarpaulin stay is inclined outward and upward, and the free end of the tarpaulin stay is used to support the first tarpaulin.

The tarpaulin stay is provided with a rod-embedding groove and a strut through-hole, and when the folding canopy is folded, the rod-embedding groove is used to engage with the first strut, the first strut is penetrated through the strut through-hole and hingedly coupled to two side walls of the strut through-hole.

The tarpaulin stay is also provided with a tarpaulin hook on a back portion of the rod-embedding groove to fix a corner of the first tarpaulin.

The tarpaulin stay includes a tarpaulin strut body and a tarpaulin hook seat at the end of the tarpaulin strut body, the tarpaulin hook seat is at the free end of the tarpaulin stay, a middle portion of the tarpaulin strut body is hinged with the first strut, and the other end of the tarpaulin strut body is hinged with the linkage rod.

The linkage rod is hingedly coupled to the second strut through a hinge seat, and two ends of the hinge seat are respectively used to connect the other end of the linkage rod and an end of the second strut.

One end of the hinge seat is used to hinge with or fixedly coupled to the other end of the linkage rod, and the other end of the hinge seat is hingedly coupled to the end of the second strut.

One end of the first strut is hingedly coupled to a center top disk, and the other end of the first strut is hingedly coupled to the second strut, the other end of the second strut is hingedly coupled to a leg tube top seat, which is located at an upper part of the canopy leg tube.

A hinge point of the first strut and the second strut is close to the end of the second strut, and a ferrule is arranged between the hinge point and the end of the second strut.

The ferrule includes a collar portion fixedly sleeved on the second strut and a clamping groove portion provided with an open groove for clamping the first strut.

A lower part of the center top disk is correspondingly provided with a center bottom disk hinged with a number of short-rib struts, an end of the short-rib strut is hinged with a middle portion of the first strut, and the center bottom disk and the center top disk form a center lock.

Compared with the prior art, the present invention has the following prominent advantages and effects. With the optimized design of the tarpaulin stay combined with the linkage rod, the present invention realizes folding and unfolding of the first strut engaged with the second strut, which may facilitate layered construction of the first tarpaulin to form a suspended roof structure, making the overall appearance aesthetic better, and also facilitating the exhaust of the roof, thereby improving the performance of the folding canopy. With the optimized hinge seat structure, the overall folding and unfolding becomes smooth, and the tarpaulin stay is optimized to avoid volume interference after folding, which ensures the original volume while having a good suspended roof supporting effect.

The features of the present invention can be clearly understood from the description of the drawings and the detailed description of the preferred embodiments.

DESCRIPTION OF THE EMBODIMENTS

In order to make the technical means, creative features, achievement goals and effects achieved by the present invention easy to understand, the present invention will be further described below in conjunction with specific illustrations.

Figure 1:
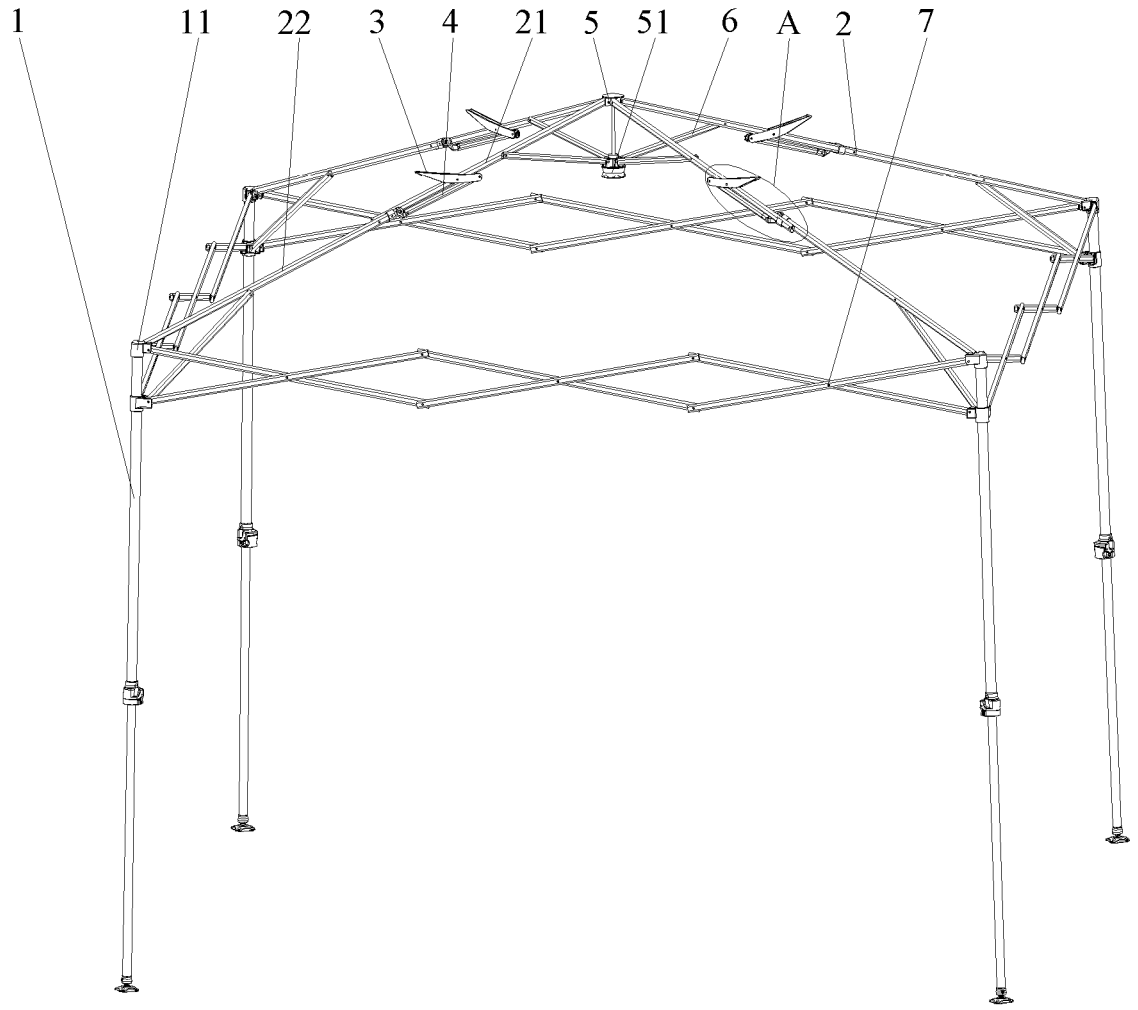
FIG. 1 is a schematic diagram 1 of an overall unfolding structure of the present invention.
Figure 2:
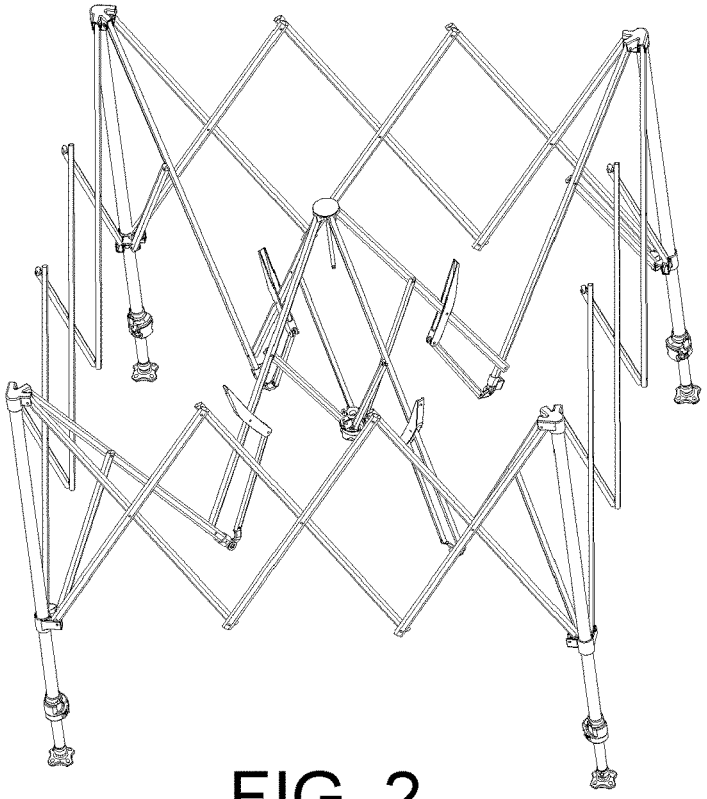
FIG. 2 is a schematic diagram 1 of an overall semi-unfolding structure of the present invention.
Figure 3:
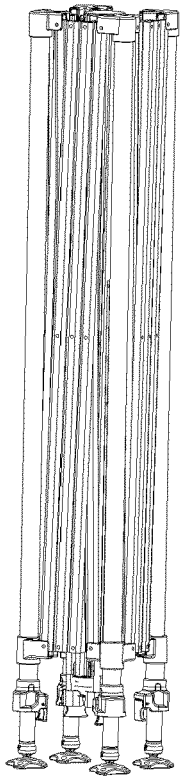
FIG. 3 is a schematic diagram 1 of an overall folding structure of the present invention.
Figure 4:
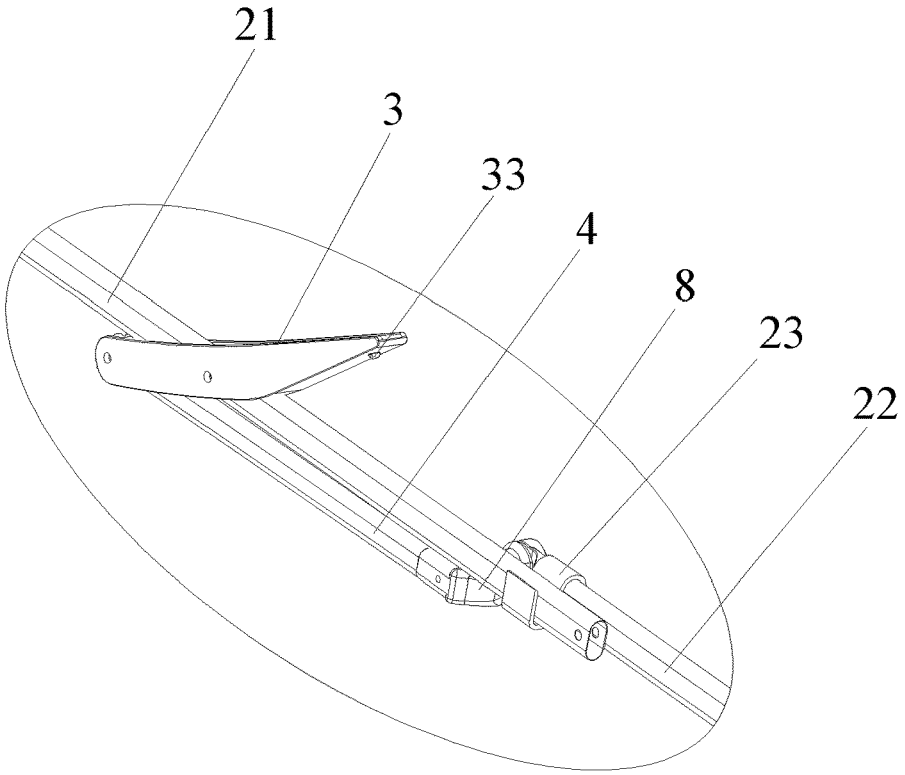
FIG. 4 is a schematic structural view of the partially zoomed part A of FIG. 1.
Figure 5:
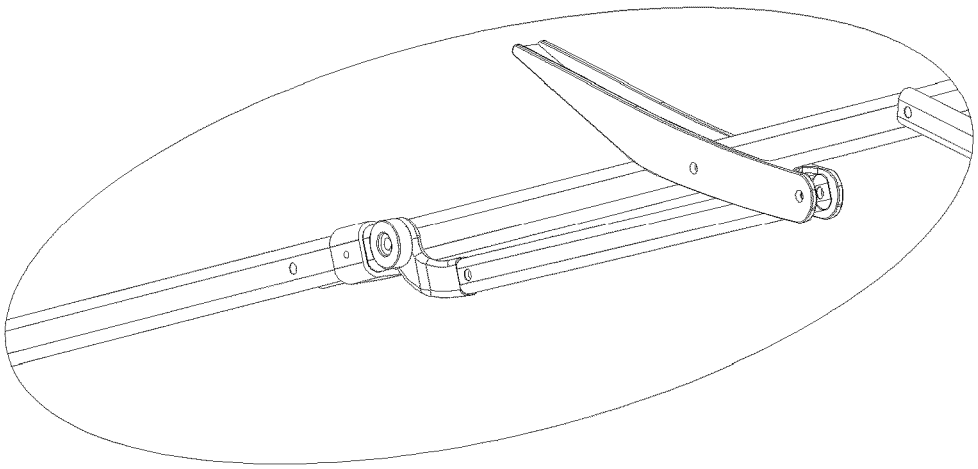
FIG. 5 is a schematic structural view 1 of an unfolding tarpaulin stay of the present invention.
Figure 6:
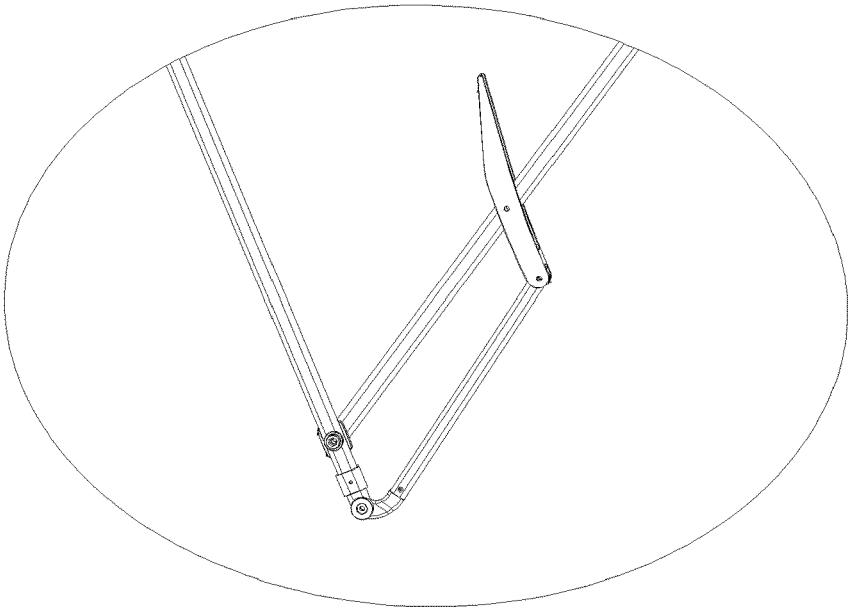
FIG. 6 is a schematic structural view 1 of a semi-unfolding tarpaulin stay structure of the present invention.
Figure 7:
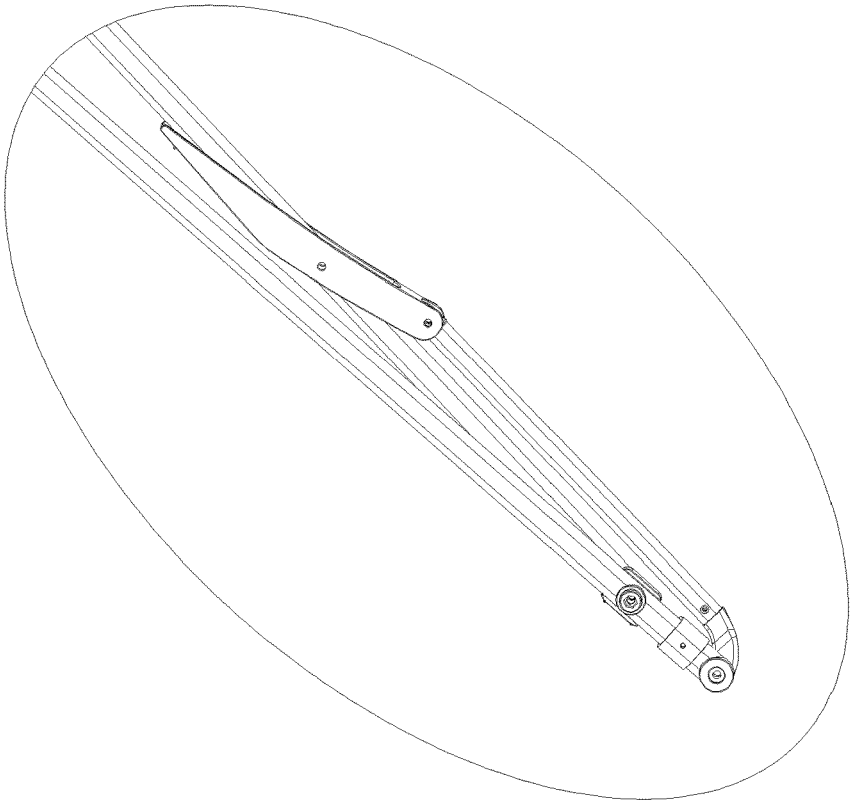
FIG. 7 is a schematic structural view 1 of a folding tarpaulin stay structure of the present invention.
Figure 8:
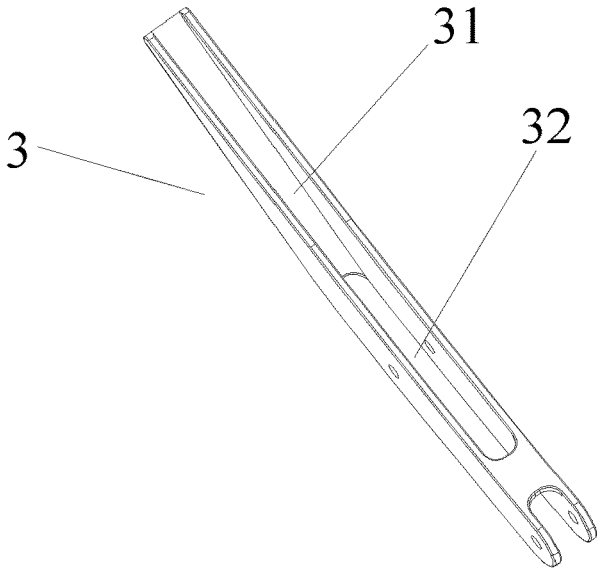
FIG. 8 is a structural schematic view 1 of a tarpaulin stay of the present invention.
Figure 9:
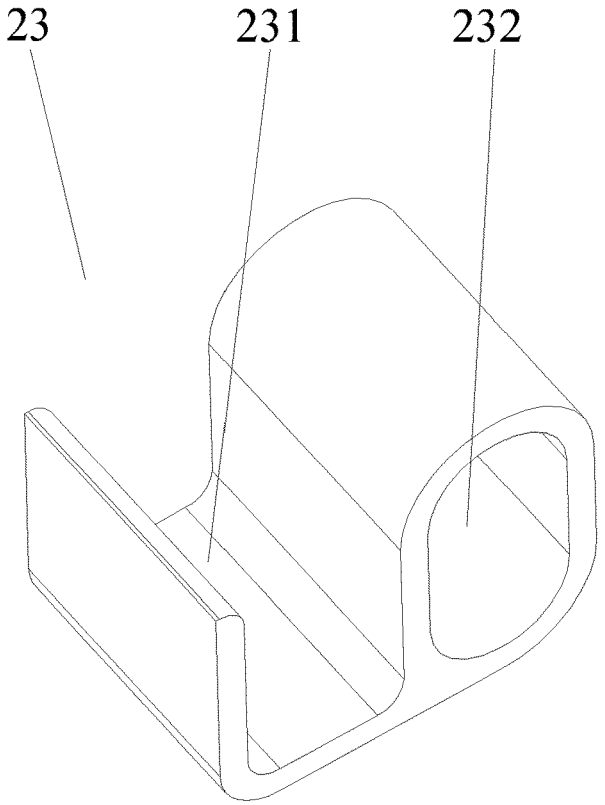
FIG. 9 is a structural schematic view of a ferrule of the present invention.
Figure 10:
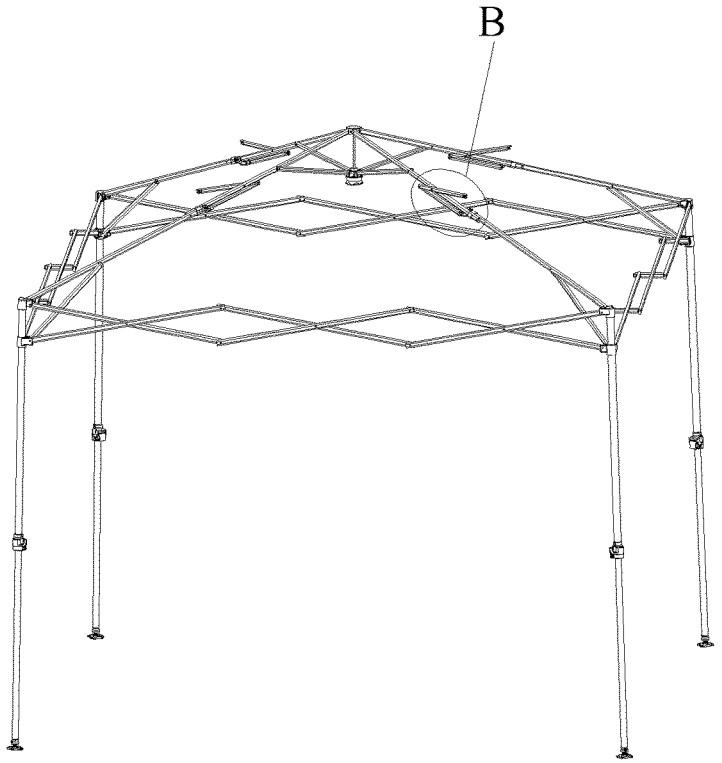
FIG. 10 is a schematic diagram 2 of an overall unfolding structure of the present invention.
Figure 11:
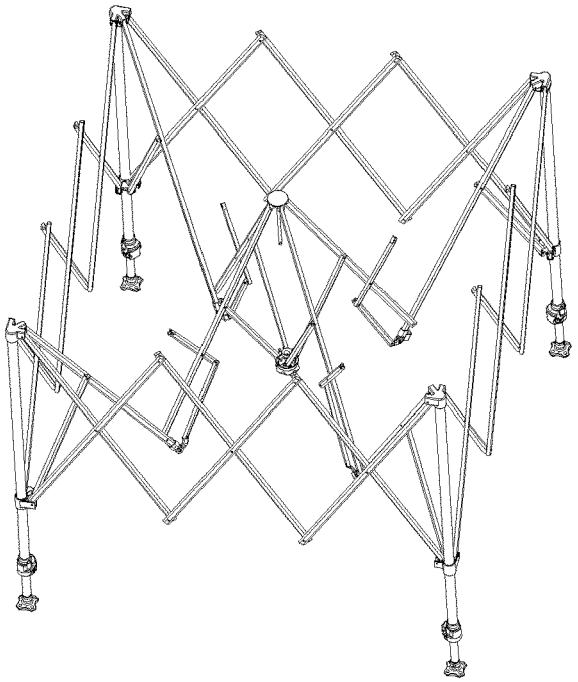
FIG. 11 is a schematic diagram 2 of an overall semi-unfolding structure of the present invention.
Figure 12:
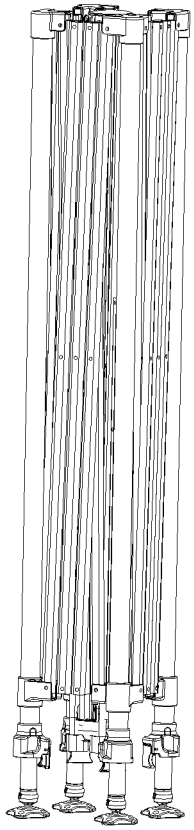
FIG. 12 is a schematic diagram 2 of an overall folding structure of the present invention.
Figure 13:
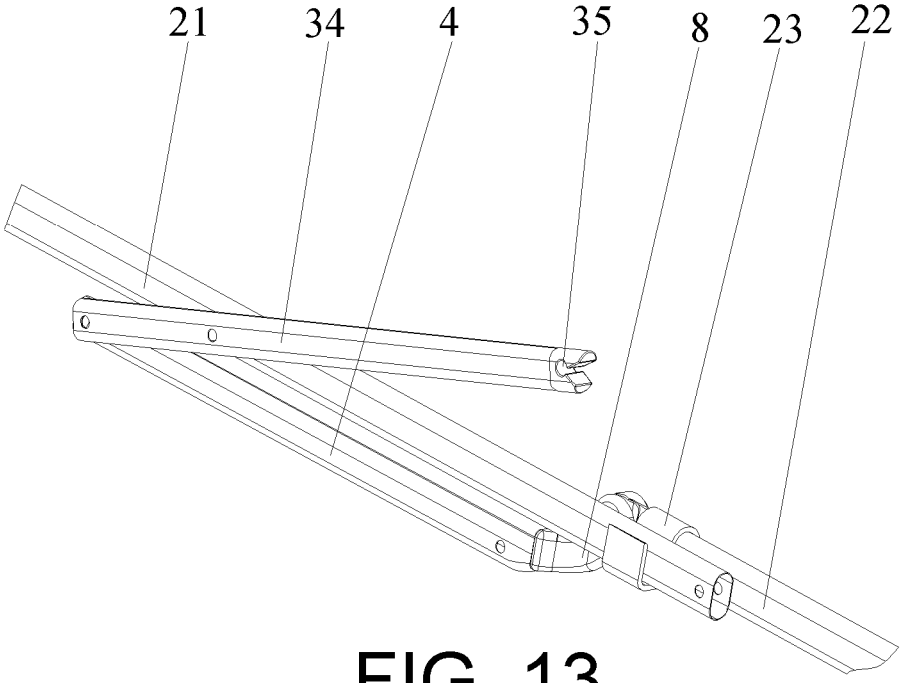
FIG. 13 is a schematic structural view of the partially zoomed part B of FIG. 10.
Figure 14:
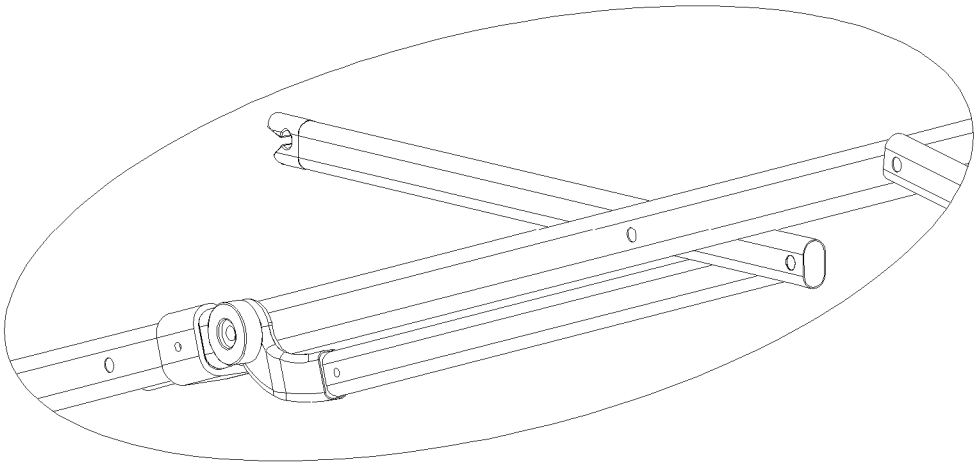
FIG. 14 is a schematic structural view 2 of an unfolding tarpaulin stay of the present invention.
Figure 15:
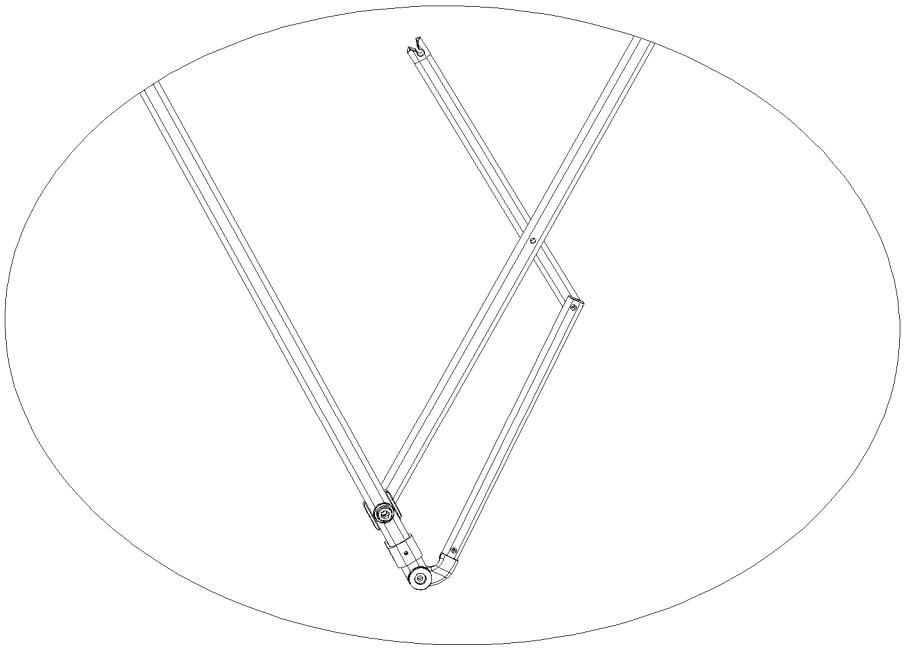
FIG. 15 is a schematic structural view 2 of a semi-unfolding tarpaulin stay structure of the present invention.
Figure 16:
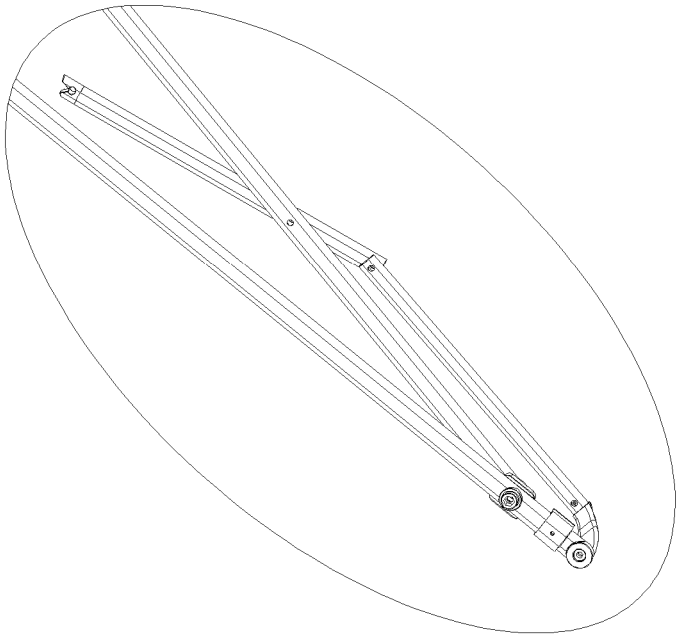
FIG. 16 is a schematic structural view 2 of a folding tarpaulin stay structure of the present invention.
Figure 17:
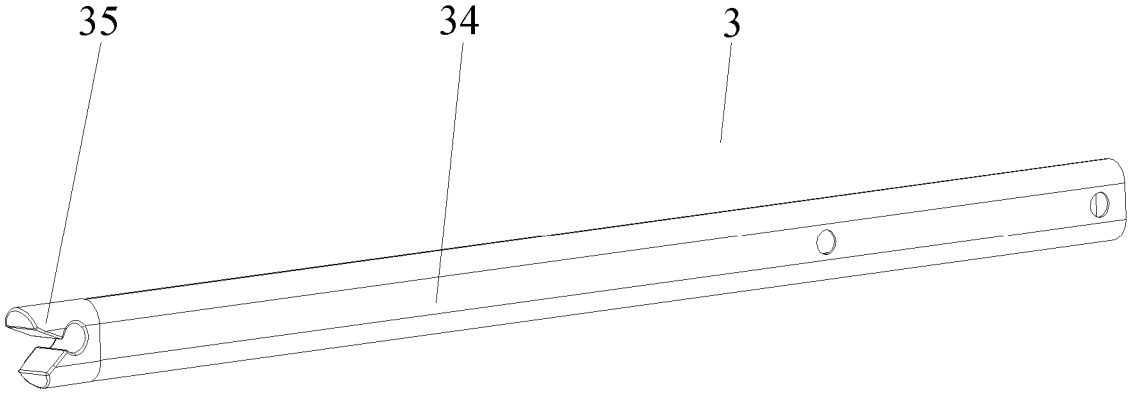
FIG. 17 is a structural schematic view 2 of a tarpaulin stay of the present invention.
Figure 18:
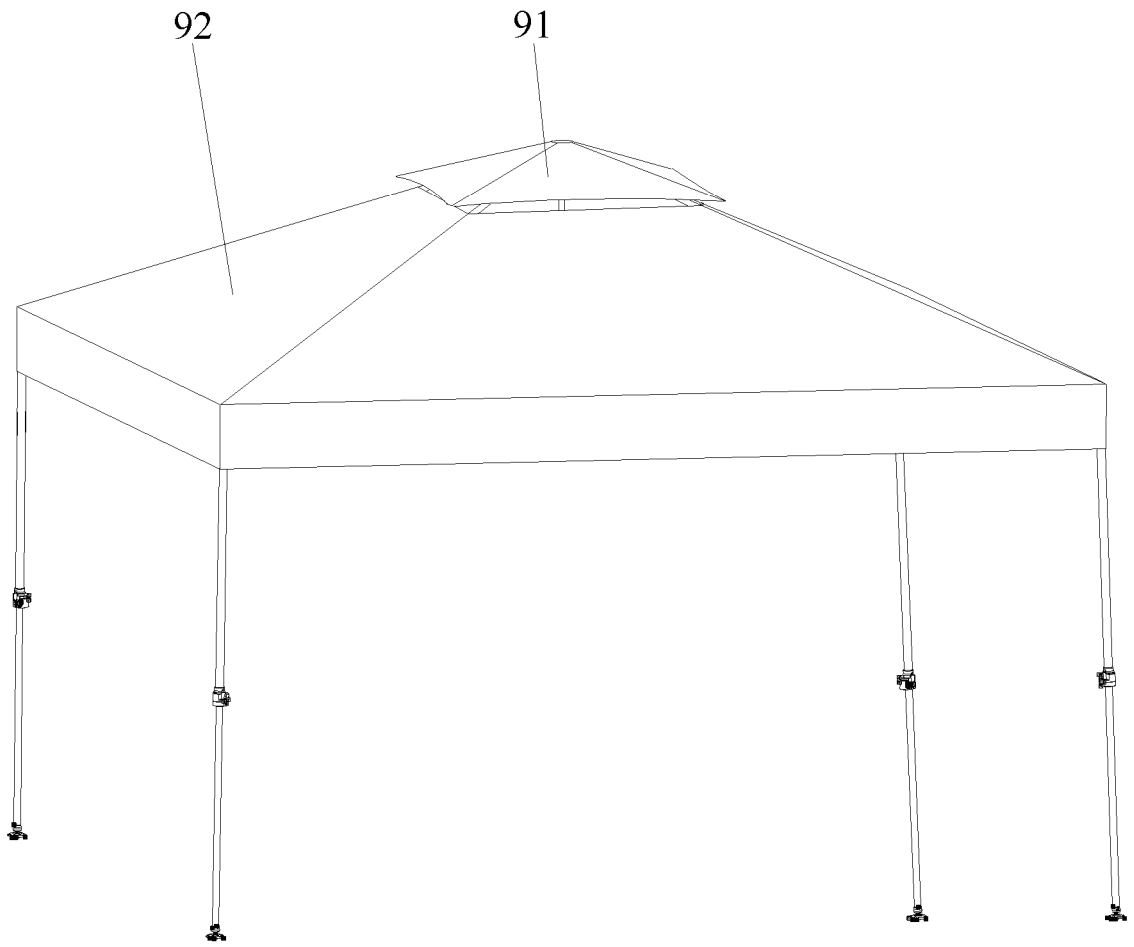
FIG. 18 is a schematic diagram of an overall structure with a tarpaulin of the present invention.

As shown in FIG. 1 to FIG. 18, the present embodiment discloses a folding canopy with a layered roof, the folding canopy includes canopy leg tubes 1, a beam assembly 7 connected between the canopy leg tubes 1, and a roof assembly for supporting a tarpaulin, the beam assembly 7 usually includes a number of beam struts hinged with each other, and a center of the folding canopy is an inner end.

Preferably, the roof assembly includes a first roof unit in a middle portion of the roof assembly and a second roof unit surrounding the first roof unit, the first roof unit is usually higher than the second roof unit, and the first roof unit is in the center of the canopy and may be a square roof, a dome, or in any other shape that could cover a gap in the middle of the second roof unit.

The first roof unit includes a first tarpaulin 91, a tarpaulin stay 3 for supporting the first tarpaulin 91, and a linkage rod 4 for linkage of the tarpaulin stay 3. A middle portion of the tarpaulin stay 3 is hinged with a first strut 21, one end of the tarpaulin stay 3 is hinged with an end of the linkage rod 4 while the other end of the tarpaulin stay is a free end, and the other end of the linkage rod 4 is hinged with a second strut 22. When the folding canopy is fully unfolded, the free end of the tarpaulin stay 3 is inclined outward and upward, and the free end of the tarpaulin stay 3 is used to support the first tarpaulin 91. With the design of a movable structure of the tarpaulin stay 3, combined with the linkage rod 4, the tarpaulin stay 3 could be turned and driven, to fully unfold the folding canopy quickly, and the folding canopy could fold and unfold in an extremely smooth way, which will not cause interference. The flip structure design of the tarpaulin stay 3 is optimized to make the first tarpaulin 91 in a relaxing state when the first tarpaulin 91 is folded, to avoid continuous tension, maintain the tension of the first tarpaulin 91 when unfolded, and increase the service life.

When the folding canopy is fully unfolded, the free end of the tarpaulin stay 3 is inclined outward and upward, and the free end of the tarpaulin stay 3 is used to support the first tarpaulin 91 in unfolding from a loose state to a tension state. When the folding canopy is folded, the free end of the tarpaulin stay 3 is turned inward to make the first tarpaulin 91 fold from the tension state to the loose state.

In one of the preferred embodiments, the tarpaulin stay 3 is also provided with a tarpaulin hook 33 located on a back portion of a rod-embedding groove 31 to fix a corner of the first tarpaulin 91, and thereby facilitating fixing and installation of the tarpaulin.

In one of the preferred embodiments, the tarpaulin stay 3 is provided with the rod-embedding groove 31 and a strut through-hole 32. When the folding canopy is folded, the rod-embedding groove 31 is used to engage with the first strut 21, the first strut 21 is penetrated through the strut through-hole 32 and hingedly coupled to two side walls of the strut through-hole 32. The rod-embedding groove 31 is in a triangular groove structure, when the canopy is in an unfolded state, a groove depth gradually decreases from a position close to the first strut 21 to the outside of the free end, a design structure of the rod-embedding groove 31 is optimized to reduce an overall volume of the rod-embedding groove 31, thereby avoiding an impact on a packaging size when the canopy is fully folded, and part of the tarpaulin stay 3 overlaps with the first strut 21, thereby reducing the size of the canopy. The structure design that the first strut 21 is penetrated through the strut through-hole 32 may improve stability of the tarpaulin stay 3, and simultaneously, the crossing design structure may reduce the volume of the canopy and make the structure more compact and reasonable. The tarpaulin stay 3 is usually made of plastic, which is directly injection molded by mold opening. A length of the free end of the tarpaulin stay 3 is designed to be adjusted according to requirement, such that a covering area of the first roof unit is no longer limited, and may be increased or decreased according to requirements.

In one of the preferred embodiments, the tarpaulin stay 3 may also be in the following design structure. The tarpaulin stay 3 includes a tarpaulin strut body 34 and a tarpaulin hook seat 35 at an end of the tarpaulin strut body 34. The tarpaulin hook seat 35 is at the free end of the tarpaulin stay 3, a middle portion of the tarpaulin strut body 34 is hinged with the first strut 21, and the other end of the tarpaulin strut body 34 is hinged with the linkage rod 4. The design is simpler compared with the structure mentioned above, and the tarpaulin strut body 34 has lower cost compared with the tarpaulin stay 3 with the rod-embedding groove 31 and the strut through-hole 32. The tarpaulin hook seat 35 is installed to fix an edge of the first tarpaulin 91. The design structure may increase a length of the tarpaulin stay 3, namely, an extension length of the free end that extends outside, and may increase the covering area of the first roof unit. A length of the free end of the tarpaulin stay 3 is designed to be adjusted according to requirement, thus the covering area of the first roof unit is no longer limited, and may be increased or decreased according to requirements.

In one of the preferred embodiments, the linkage rod 4 is hingedly coupled to the second strut 22 through a hinge seat 8, and two ends of the hinge seat 8 are respectively used to connect an end of the linkage rod 4 and an end of the second strut 22. One end of the hinge seat 8 is hingedly coupled to the end of the linkage rod 4, and the other end of the hinge seat 8 is hingedly coupled to the end of the second strut 22. A hinge joint of the first strut 21 and the second strut 22, the hinge seat 8, a hinge joint of the linkage rod 4 and the tarpaulin stay 3, and a hinge joint of a tarpaulin strut 3 and the first strut 21 form a movable quadrilateral, and as the canopy is folded or unfolded, the quadrilateral deforms. The structure of the hinge seat 8 is optimized to increase a movement stroke between the linkage rod 4 and the second strut 22. In the design, the linkage rod 4 may be directly hinged with the second strut 22, but an overall deformation in the design is relatively rigid and easy to cause interference. By virtue of the hinge seat 8, it may increase a fault tolerance of deformation to make the full folding and unfolding more smooth and convenient. Generally, both a structure between the hinge seat 8 and the second strut 22 and a structure between the hinge seat 8 and the linkage rod 4 are hinge structures, which may increase amount of deformation. In addition, in this embodiment, a design of one hinged-end and one fixed-end may be used, and generally, the hinged seat 8 is used to fixedly couple to the end of the linkage rod 4.

In one of the preferred embodiments, one end of the first strut 21 is hingedly coupled to a center top disk 5, and the other end of the first strut 21 is hingedly coupled to the second strut 22. The other end of the second strut 22 is hingedly coupled to a leg tube top seat 11, and the first strut 21 and the second strut 22 are usually combined to form a canopy strut 2 for supporting the tarpaulin. The leg tube top seat 11 is disposed on an upper part of the canopy leg tube 1. The second strut 22 is used to support a second tarpaulin 92, and an outer end portion of the first strut 21 is used to support the second tarpaulin 92. Or, when the outermost end of the free end of the tarpaulin stay 3 extends to the end of the second strut 22, the first strut 21 does not need to support the second tarpaulin 92. The hinge point of the first strut 21 and the second strut 22 is close to the end of the second strut 22, and a ferrule 23 is arranged between the hinge point and the end of the second strut 22. The ferrule 23 includes a collar portion 232 fixedly sleeved on the second strut 22 and a clamping groove portion 231 provided with an open groove for clamping the first strut 21, and the ferrule 23 is used to improve stability of the first strut 21 and the second strut 22 when the canopy is in the unfolded state.

In other embodiments, the second strut 22 may also consist of two or more struts hinged end to end, which may be designed according to the specifications and sizes of existing folding canopies.

In one of the preferred embodiments, a lower part of the center top disk 5 is correspondingly provided with a center bottom disk 51 hinged with a number of short-rib struts 6. An end of the short-rib strut 6 is hinged to the center bottom disk 51, and the other end of the short-rib strut 6 is hinged with a middle portion of the first strut 21, and the center bottom disk 51 and the center top disk 5 form a center lock. A structure of the center lock is commonly used in the prior art, and details are not described herein.

The specific working principle of the present invention is as follows. When the canopy is converted from a folded state to the unfolded state, as the canopy leg tubes 1 spread out, the beam assembly 7 and the entire roof are unfolded. Referring to an unfolding structure of the folding canopy in the prior art, when the folding canopy is in the folded state, the inner end of the first strut 21 is in an upper position, the hinge point of the first strut 21 and the second strut 22 is in a lower position, and a hinge point of the second strut 22 and the leg tube top seat 11 is in an upper position. As the folding canopy is unfolded, and the linkage rod 4 is close to or attached to one side of the first strut 21, the hinge point of the first strut 21 and the second strut 22 changes, an original angle between the first strut 21 and the second strut 22 tends to 0°, and as the angle gradually increases, the second strut 22 drives the hinge seat 8 to change, such that the hinge seat 8 drives the linkage rod 4 to gradually move away from the first strut 21. The quadrilateral formed by the hinge joint of the first strut 21 and the second strut 22, the hinge seat 8, the hinge joint of the linkage rod 4 and the tarpaulin stay 3, and the hinge joint of a tarpaulin strut 3 and the first strut 21 is deformed. The canopy continues to be unfolded, when the quadrilateral tends to be rectangular, generally, and when the angle between the first strut 21 and the second strut 22 is 90°, the canopy continues to be unfolded, the linkage rod 4 gradually approaches the first strut 21 until the entire folding canopy is unfolded. When the folding canopy is entirely unfolded, generally, the linkage rod 4 is close to or attached to one side of the first strut 21, the angle between the first strut 21 and the second strut 22 tends to be 180°, at the same time, the linkage rod 4 drives the tarpaulin stay 3 to complete a flip, and the free end of the tarpaulin stay 3 completes the flip in an arc-shaped trajectory, thereby unfolding the first tarpaulin 91.

With the optimized design of the tarpaulin stay combined with the linkage rod, the present invention realizes folding and unfolding of the first strut engaged with the second strut, which may facilitate layered construction of the first tarpaulin to form a suspended roof structure, making the overall appearance aesthetic better, and also facilitating the exhaust of the roof, thereby improving the performance of the folding canopy. With the optimized hinge seat structure, the overall folding and unfolding becomes smooth, and the tarpaulin stay is optimized to avoid volume interference after folding, which ensures the original volume while having a good suspended roof supporting effect.

It is apparent from the technical knowledge that the present invention can be implemented by other embodiments without departing from the spirit or essential characteristics thereof. Therefore, the above-disclosed embodiments are merely illustrative and not exclusive in all respects. All changes which are within the scope of the present invention or equivalent to the scope of the present invention are encompassed by the present invention.

What is claimed is:

1. A folding canopy with layered roof, comprising canopy leg tubes, a beam assembly connected between the canopy leg tubes, and a roof assembly for supporting a tarpaulin, wherein the roof assembly comprises a first roof unit in a middle portion of the roof assembly and a second roof unit surrounding the first roof unit, wherein the first roof unit comprises a first tarpaulin, a tarpaulin stay for supporting the first tarpaulin, and a linkage rod for linkage of the tarpaulin stay, a middle portion of the tarpaulin stay is hinged with a first strut, one end of the tarpaulin stay is hinged with an end of the linkage rod and the other end of the tarpaulin stay is a free end, and the other end of the linkage rod is hinged with a second strut; when the folding canopy is fully unfolded, the free end of the tarpaulin stay is inclined outward and upward, and the free end of the tarpaulin stay supports the first tarpaulin.

2. The folding canopy with layered roof according to claim 1, wherein the tarpaulin stay is provided with a rod-embedding groove and a strut through-hole, and when the folding canopy is folded, the rod-embedding groove engages with the first strut, the first strut is penetrated through the strut through-hole and hingedly coupled to two side walls of the strut through-hole.

3. The folding canopy with layered roof according to claim 2, wherein the tarpaulin stay is further provided with a tarpaulin hook located on a back portion of the rod-embedding groove to fix a corner of the first tarpaulin.

4. The folding canopy with layered roof according to claim 1, wherein the tarpaulin stay comprises a tarpaulin strut body and a tarpaulin hook seat at an end of the tarpaulin strut body, the tarpaulin hook seat is at the free end of the tarpaulin stay, a middle portion of the tarpaulin strut body is hinged with the first strut, and the other end of the tarpaulin strut body is hinged with the linkage rod.

5. The folding canopy with layered roof according to claim 1, wherein the linkage rod is hingedly coupled to the second strut through a hinge seat, and two ends of the hinge seat are respectively connected the other end of the linkage rod and an end of the second strut.

6. The folding canopy with layered roof according to claim 5, wherein one end of the hinge seat is hingedly or fixedly coupled to the other end of the linkage rod, and the other end of the hinge seat is hingedly coupled to the end of the second strut.

7. The folding canopy with layered roof according to claim 5, wherein one end of the first strut is hingedly coupled to a center top disk, and the other end of the first strut is hingedly coupled to the second strut, the other end of the second strut is hingedly coupled to a leg tube top seat, and the leg tube top seat is located at an upper part of the canopy leg tube.

8. The folding canopy with layered roof according to claim 7, wherein a hinge point of the first strut and the second strut is close to the end of the second strut, and a ferrule is arranged between the hinge point and the end of the second strut.

9. The folding canopy with layered roof according to claim 8, wherein the ferrule comprises a collar portion fixedly sleeved on the second strut and a clamping groove portion provided with an open groove for clamping the first strut.

10. The folding canopy with layered roof according to claim 7, wherein a lower part of the center top disk is correspondingly provided with a center bottom disk hinged with a number of short-rib struts, an end of each of the short-rib struts is hinged with a middle portion of the first strut, and the center bottom disk and the center top disk form a center lock.

* * * * *